US009060548B2

(12) United States Patent
Zheng et al.

(10) Patent No.: US 9,060,548 B2
(45) Date of Patent: Jun. 23, 2015

(54) FAST CONNECTOR OF ELECTRONIC CIGARETTE

(71) Applicant: Shenzhen Boge Technology Co., Ltd., Guangdong (CN)

(72) Inventors: Junxiang Zheng, Guangdong (CN); Xianhui Zhang, Guangdong (CN)

(73) Assignee: SHENZHEN BOGE TECHNOLOGY Co., Ltd., Shenzhen, Guangdong (CN)

( * ) Notice: Subject to any disclaimer, the term of this patent is extended or adjusted under 35 U.S.C. 154(b) by 106 days.

(21) Appl. No.: 14/009,114

(22) PCT Filed: Jun. 20, 2013

(86) PCT No.: PCT/CN2013/077517
§ 371 (c)(1),
(2) Date: Oct. 1, 2013

(87) PCT Pub. No.: WO2014/117467
PCT Pub. Date: Aug. 7, 2014

(65) Prior Publication Data

US 2015/0118895 A1 Apr. 30, 2015

(30) Foreign Application Priority Data

Feb. 4, 2013 (CN) ..... 2013 2 0063122 U

(51) Int. Cl.
*A24F 25/02* (2006.01)
*A24F 47/00* (2006.01)
*H01R 13/66* (2006.01)

(52) U.S. Cl.
CPC ..... *A24F 47/008* (2013.01); *H01R 13/66* (2013.01)

(58) Field of Classification Search
CPC ..... Y02E 60/12; H01M 2/20; H01R 13/26; H01R 33/09; H01R 13/2421; H01R 13/2428; A24F 47/008; A24F 25/02; A24F 11/00; A24F 1/32; B44C 7/027
See application file for complete search history.

(56) References Cited

U.S. PATENT DOCUMENTS

2011/0304282 A1* 12/2011 Li et al. ..... 315/362
2013/0298905 A1* 11/2013 Levin et al. ..... 128/202.21
2013/0340779 A1* 12/2013 Liu ..... 131/329
2014/0053857 A1* 2/2014 Liu ..... 131/329
2014/0373833 A1* 12/2014 Liu ..... 128/202.21

* cited by examiner

*Primary Examiner* — Gary Paumen
(74) *Attorney, Agent, or Firm* — Andrew W. Chu; Craft Chu PLLC

(57) ABSTRACT

A fast connector of electronic cigarette comprising a battery adaptor plate 201 above a battery 10, wherein a top surface of the battery adaptor plate 201 is welded with a pair of resilient battery columns 30; a bottom surface of the battery adaptor plate 201 is welded with a 2 pin socket 202; the 2 pin socket 202 and the battery 10 are connected, and the 2 pin socket 202 is connected to the resilient battery columns 30 via the battery adaptor plate 201; upper ends of the resilient battery columns 30 support against a vaporizer socket 40; a pair of electrode columns 401 and a heating wire 403 are fixed on the vaporizer socket 40; two ends of the heating wire 403 are welded and conducted with the electrode columns 401 via conduction wires 402.

3 Claims, 2 Drawing Sheets

FAST CONNECTOR OF ELECTRONIC CIGARETTE

BACKGROUND OF THE INVENTION

The present invention relates to a fitting part of an electronic cigarette, and more specifically relates to a fast connector of an electronic cigarette.

The use of vaporized plant essential oil in an electronic cigarette available nowadays in lieu of a real cigarette is environmentally friendly and free from the hazards caused by second hand smoking and is therefore well-received in the market. According to an electronic cigarette which uses vaporized plant essential oil, a connecting device (a connecter, i.e. a fast connector of an electronic cigarette according to the present invention) is required between the battery and the vaporizer of the electronic cigarette. The connecting device connects the electric heating wires on the vaporizer with the cathode and anode of the battery.

As shown in FIG. 3, a connector of an existing electronic cigarette which uses vaporized plant essential oil is divided into an upper part and a lower part. The upper part and the lower part are connected by screw thread connection. The upper part comprises an outer screw thread ring 11, an upper insulation ring 12 and an elongated metal ring 13, and these three components are fitted with one another by press fitting, wherein the upper insulation ring 12 is placed between the outer screw thread ring 11 and the elongated metal ring 13. The outer screw thread ring 11 and the elongated metal ring 13 each forms an electrical pole and they are welded with heating wires via conduction wires to form communication paths. The lower part comprises an inner screw thread ring 14, a lower insulation ring 15 and a short metal ring 16, and these three components are fitted with one another by press fitting, wherein the lower insulation ring 15 is placed between the inner screw thread ring 14 and the short metal ring 16. The inner screw thread ring 14 and the short metal ring 16 each forms an electrical pole and they are connected respectively to a cathode and to an anode of a battery via conduction wires.

A total of four structural parts at two ends of the connector as described above can only be manufactured using a sophisticated lathe. Therefore, the cost is very high. Also, metal structural parts require fitting by means of press fitting via insulation rings, and conduction wires are then required to be welded thereon. Accordingly, the manufacturing process is complicated and the costs for manufacturing and assembling are high.

BRIEF SUMMARY OF THE INVENTION

In view of the aforesaid disadvantages now present in the prior art, the present invention provides a fast connector of an electronic cigarette, wherein an upper end of the fast connector comprises electrical poles on a vaporizer socket, a lower end of the fast connector comprises a battery adaptor plate, and a middle section of the fast connector is fixed with resilient battery columns. The present invention has a simple structure and high production efficiency. The present invention is also easy to manufacture and its manufacturing cost is low.

The present invention has the following technical proposal:

A fast connector of electronic cigarette comprising a battery adaptor plate 201 above a battery 10, wherein

- a top surface of the battery adaptor plate 201 is welded with a pair of resilient battery columns 30 to form two electrical poles at a lower end of the fast connector;
- a bottom surface of the battery adaptor plate 201 is welded with a 2 pin socket 202; the 2 pin socket 202 and the battery 10 are connected to achieve conduction, and the 2 pin socket 202 is connected to the resilient battery columns 30 via the battery adaptor plate 201;
- upper ends of the resilient battery columns 30 support against a vaporizer socket 40;
- a pair of electrode columns 401 and a heating wire 403 are fixed on the vaporizer socket 40; two ends of the heating wire 403 are welded and conducted with the electrode columns 401 via conduction wires 402;

In addition to the above technical proposal, the resilient battery columns 30 meet a predetermined standard and each comprises:

- a bottom shell 301 disposed with a hollow cavity whose opening faces upwardly;
- a spring 302 inside the hollow cavity; and
- a movable probing head 303 disposed at the opening of the hollow cavity.

In addition to the above technical proposal, the battery adaptor plate 201 is disposed inside a battery socket 20; the battery socket 20 is in a cylindrical shape; inner wall of the battery socket 20 is disposed with an arc-shaped insertion slot; the vaporizer socket 40 is disposed with a platform; when the vaporizer socket 40 inserts into the battery socket 20, the platform of the vaporizer socket 40 inserts into the arc-shaped insertion slot, so that the vaporizer socket 40 connects and communicates with the battery 10 after the vaporizer socket 40 is rotated along the arc-shaped insertion slot.

According to the present invention, an upper end of the fast connector of electronic cigarette comprises electrical poles on a vaporizer socket, a lower end of the fast connector of electronic cigarette comprises a battery adaptor plate, and a middle section of the fast connector of electronic cigarette is fixed with resilient battery columns. The present invention has a simple structure and high production efficiency. The present invention is also easy to manufacture and its manufacturing cost is low.

DETAILED DESCRIPTION OF THE INVENTION

The present invention is further described in detail below with reference to the accompanying drawings.

Figure 1:
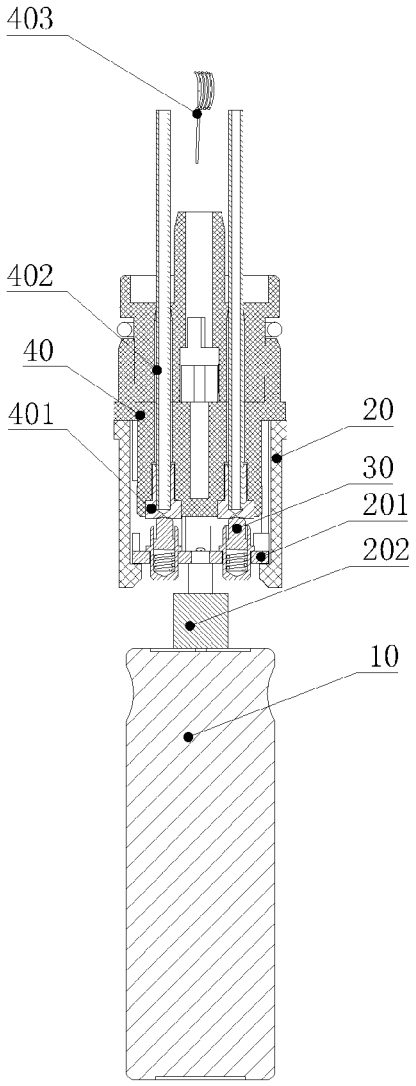
FIG. 1 illustrates a structure of the fast connector of electronic cigarette according to the present invention.
Figure 2:
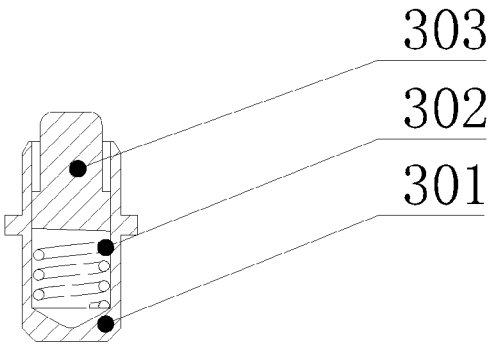
FIG. 2 illustrates a structure of one of the resilient battery columns according to the present invention.
Figure 3:
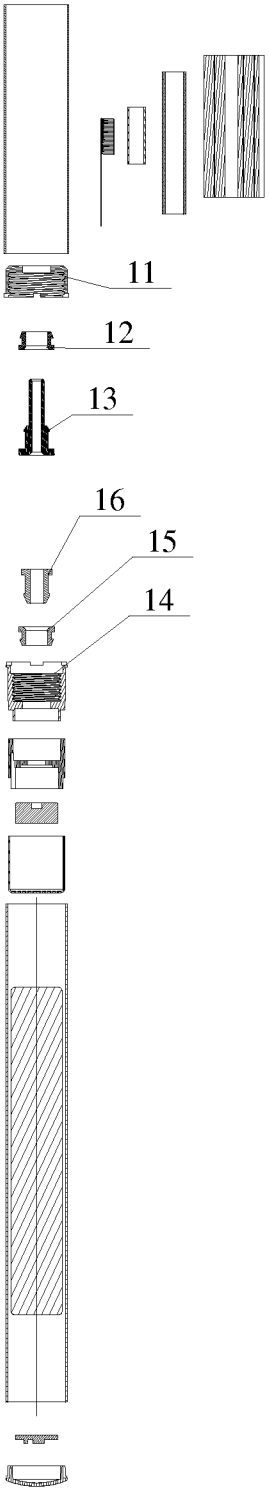
FIG. 3 illustrates a structure of a connector of an electronic cigarette according to prior art.

As shown in FIG. 1, the fast connector of electronic cigarette according to the present invention comprises:

- a battery adaptor plate 201 above a battery 10, wherein
- a top surface of the battery adaptor plate 201 is welded with a pair of resilient battery columns 30 to form two electrical poles at a lower end of the fast connector;
- a bottom surface of the battery adaptor plate 201 is welded with a 2 pin socket 202; the 2 pin socket 202 and the battery 10 are connected to achieve conduction, and the 2 pin socket 202 is connected to the resilient battery columns 30 via the battery adaptor plate 201;
- upper ends of the resilient battery columns 30 support against a vaporizer socket 40;

a pair of electrode columns 401 and a heating wire 403 are fixed on the vaporizer socket 40; two ends of the heating wire 403 are welded and conducted with the electrode columns 401 via conduction wires 402;

the fast connector is fixed on a vaporizer tube and constitutes a main part of a vaporizer.

In addition to the above technical proposal, the resilient battery columns 30 meet a predetermined standard and each comprises:

a bottom shell 301 disposed with a hollow cavity whose opening faces upwardly;

a spring 302 inside the hollow cavity; and a movable probing head 303 disposed at the opening of the hollow cavity.

In addition to the above technical proposal, the battery adaptor plate 201 is disposed inside a battery socket 20; the battery socket 20 is in a cylindrical shape; inner wall of the battery socket 20 is disposed with an arc-shaped insertion slot; the vaporizer socket 40 is disposed with a platform; when the vaporizer socket 40 inserts into the battery socket 20, the platform of the vaporizer socket 40 inserts into the arc-shaped insertion slot, so that the vaporizer socket 40 connects and communicates with the battery 10 after the vaporizer socket 40 is rotated along the arc-shaped insertion slot.

The present invention has a simple structure. Sophisticated metal structural parts are not required. Therefore, cost of the present invention is only half the cost of an existing metal connector. Also, welding of the resilient battery columns on the battery adaptor plate can be achieved by automated manufacturing technique, thereby lowering the manufacturing cost significantly and improving efficiency which is 10 times more efficient than manual welding.

The present invention is not limited to the above embodiment which is the most preferable embodiment. Any person skilled in this field of art can make structural changes to the vaporizer socket and the resilient battery columns as derived from the teaching of the present invention, and any technical proposal identical with or similar to the present invention should fall within the scope of protection of the present invention.

Disclosure not described in detail herein belongs to prior art which is known to any person skilled in this field of art.

What is claimed is:

1. A fast connector of electronic cigarette comprising a battery adaptor plate 201 above a battery 10, wherein a top surface of the battery adaptor plate 201 is welded with a pair of resilient battery columns 30 to form two electrical poles at a lower end of the fast connector;

a bottom surface of the battery adaptor plate 201 is welded with a 2 pin socket 202; the 2 pin socket 202 and the battery 10 are connected to achieve conduction, and the 2 pin socket 202 is connected to the resilient battery columns 30 via the battery adaptor plate 201;

upper ends of the resilient battery columns 30 support against a vaporizer socket 40;

a pair of electrode columns 401 and a heating wire 403 are fixed on the vaporizer socket 40; two ends of the heating wire 403 are welded and conducted with the electrode columns 401 via conduction wires 402.

2. The fast connector of electronic cigarette as in claim 1, wherein the resilient battery columns 30 meet a predetermined standard and each comprises:

a bottom shell 301 disposed with a hollow cavity whose opening faces upwardly;

a spring 302 inside the hollow cavity; and a movable probing head 303 disposed at the opening of the hollow cavity.

3. The fast connector of electronic cigarette as in claim 1, wherein the battery adaptor plate 201 is disposed inside a battery socket 20; the battery socket 20 is in a cylindrical shape; inner wall of the battery socket 20 is disposed with an arc-shaped insertion slot; the vaporizer socket 40 is disposed with a platform; when the vaporizer socket 40 inserts into the battery socket 20, the platform of the vaporizer socket 40 inserts into the arc-shaped insertion slot, so that the vaporizer socket 40 connects and communicates with the battery 10 after the vaporizer socket 40 is rotated along the arc-shaped insertion slot.

* * * * *